United States Patent [19]

Gent et al.

[11] Patent Number: 5,021,267

[45] Date of Patent: Jun. 4, 1991

[54] TREATMENT OF CORDS, THREADS AND FILAMENTS

[75] Inventors: John A. G. Gent, Liphook; Jacob M. Blass, London, both of England

[73] Assignee: Cogent Limited, London, England

[21] Appl. No.: 488,881

[22] Filed: Mar. 6, 1990

[30] Foreign Application Priority Data

Mar. 21, 1989 [GB] United Kingdom ..... 8906422

[51] Int. Cl.[5] ..... B05D 3/02

[52] U.S. Cl. ..... 427/387; 427/393.5; 428/395

[58] Field of Search ..... 427/387, 389.9, 393.5; 428/395

[56] References Cited

U.S. PATENT DOCUMENTS 3,870,542 3/1975 Ida et al. ..... 427/389.9

4,847,120 7/1989 Gent ..... 106/287.11 X

*Primary Examiner*—Michael Lusignan

*Attorney, Agent, or Firm*—Longacre & White

[57] ABSTRACT

A cord, thread or filament is treated by applying to it a dilute solution of a polysiloxane prepolymer which is then cured, such that either (a) the outer envelope of the cord, thread or filament is enrobed, or (b) in the case of a cord or thread, the filaments thereof are substantially individually encapsulated by, a coating of cured polysiloxane polymer. The treated cords, threads and filaments have inter alia improved abrasion and fray resistance, water repellance and slip qualities.

13 Claims, 1 Drawing Sheet

TREATMENT OF CORDS, THREADS AND FILAMENTS

FIELD OF THE INVENTION

The purpose of the present invention is to treat cords, threads and filaments so as to improve their properties.

It is concerned in particular to improve the abrasion or fray resistance of such substrates, and their water-repellence. It may also confer desired slip and other handling qualities.

The treatment is applicable to cords or threads (braided, twisted or straight) and filaments and also to bundles of filaments as in unspun or only very lightly spun cotton and other flosses.

Indeed, it is particularly relevant to the treatment of straight multi-filament flosses and also to single filaments.

SUMMARY OF THE INVENTION

The treatment comprises applying to the cord, thread or filament a dilute solution of a polysiloxane prepolymer and curing the prepolymer in situ so as to either enrobe the outer envelope of a cord or thread or encapsulate, substantially individually, the filament or filaments of the cord, thread or filament.

The solids content of the prepolymer solution and the process conditions are controlled such that there is substantially no connective encapsulation of filaments within the substrate, that is to say substantially no matrix-formation whereby two or more of the filaments are permanently or substantially bridged together by cured polysiloxane.

The prepolymer suitable for this treatment is one as disclosed in our European Patent Application Publication No. 215676 (U.S. Pat. No. 4,847,120 to Gent) or in our subsequent EP Application No. 306302 (corresponding U.S. Ser. No. 23740 in the name of Gent filed on of Aug. 29, 1988), that is to say an acidic solution of a polysiloxane prepolymer having both non-co-reactive side groups and co-reactive side groups, the co-reactive side groups being additional to siloxane linkage-forming alkoxy, hydroxy or carboxy groups or hydrolysable derivatives thereof, the co-reactive and non-co-reactive groups being linked to respectively different Si atoms, the prepolymer being curable by solvent evaporation to cause the formation of further siloxane linkages and also reaction together of the co-reactive groups to cure and cross-link the polymer. The prepolymer is formed in situ in a volatile medium such that upon evaporation of the medium a spontaneous curing of the prepolymer occurs. In the first of said applications the medium is aqueous throughout; in the second, after the preparation of the prepolymer an organic solvent is substituted for the aqueous solvent, and the prepolymer is presented for use in the form of an essentially organic solution. In this latter form, the increased volatility of the solvent implies shorter treatment and cure times and/or the use of lower temperatures after application of the prepolymer solution to the substrate.

The chemical nature of the substrate is not important; however particularly preferred substrates are polyamides (e.g. nylon), frequently used for high tensile strength cords.

Although the treatment has application to any cords, threads or filaments of which it is desired to improve the abrasion or fray resistance, particular fields of application can be identified for the treatment of dental flosses, where resistance to fray is particularly important and also a smooth "feel" is desirable, in fishing lines, especially monofilament fishing lines, and in stitching threads especially those used for example in stitching shoes, leather, canvas and analogous articles.

Fray resistance, water-repellence and also good slip are important in all these application. Additionally it has been found that the present treatment does not adversely effect the "tieability" of the lines.

It is common to wax cords, threads and filaments to improve their feel and slip. Although substrates treated according to the invention may be waxed if desired, the treatment may render that unnecessary.

The method of treatment may involve the use of known coating machines for example one wherein the substrate cord, thread or filament is led through a bath in which it is submerged in charge of the prepolymer solution, and is then led through a drying/curing area before being wound up in its substantially cured condition. In one variant the substrate runs around an idler roller submerged in a bath; in another it dips through a covered trough. It is extracted by pull rollers which at the same time squeeze off excess solution. It then passes to a curing/drying area before being wound up.

In any case, the solid contents of the prepolymer solution and other process conditions are controlled so that either the coating provides a protective sheath enrobing a multi-filament substrate or the individual filaments are individually coated so as substantially to avoid bridging between different filaments of the substrate. In the latter case, broadly speaking the lower the solid content the greater the shrinkage of the liquid deposited on the substrate as evaporation and cure proceeds and the less likely there is to be bridging across different filaments and also the lower the pressure exerted on the substrate the less likely there is to be bridging i.e. the object of the process stage is the opposite of achieving impregnation and matrix formation. In the former case, a higher solids content and low pressure at all times is indicated.

DETAILED DESCRIPTION OF THE INVENTION

Figure 1:
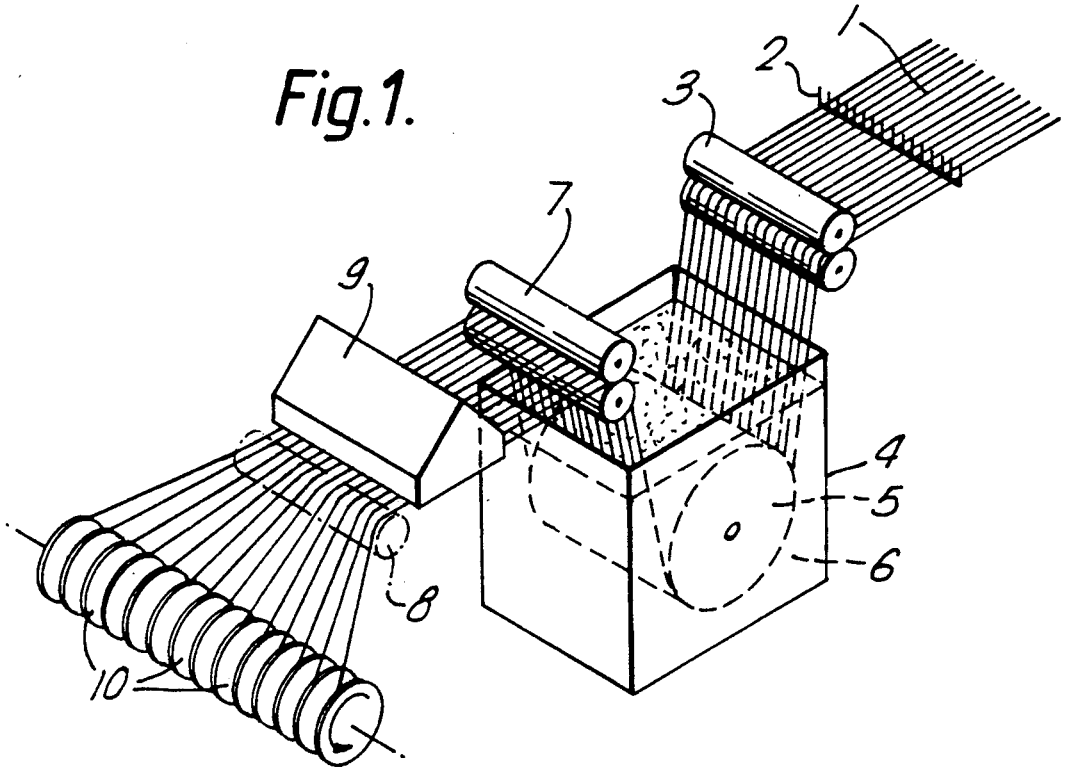
FIG. 1 is a diagrammatic perspective view of one apparatus for treating substrates according to the invention.

Looking first at FIG. 1, threads 1 of substrates from separate supply reels are led through a comb 2 and between supply rollers 3 before passing into a bath 4 where they run round an idle roller 5 submerged in a polysiloxane prepolymer solution 6 prepared as described in any of our said applications. After having received a charge of the prepolymer they pass out by idler rolls 7 to draw rolls 8 passing on the way a curing box 9 where heat and/or ventilation is applied to the treated substrate. The coated substrates with fully cured coatings are then wound up on individual reels or bobbins 10.

Figure 2:
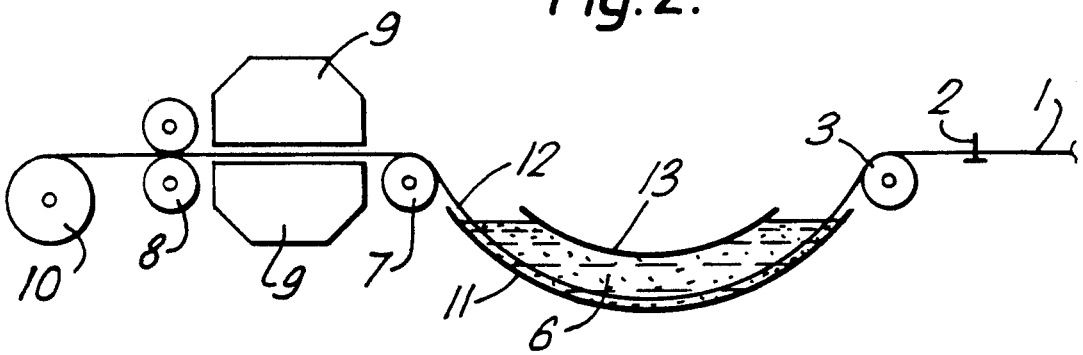
FIG. 2 is a cross-sectional view of another apparatus.

The arrangement is similar in FIG. 2 except that submersion occurs freely within an enclosed trough 11, through which a loop 12 of substrate dips. A cover 13 encloses the trough to diminish unwanted evaporation and to cut down the volume of solution 6 charged into the trough. The coated substrates then proceed to idle rolls 7, curing hoods 9 and draw rolls 8, to wind up reels or bobbins 10 as before.

Figure 3:
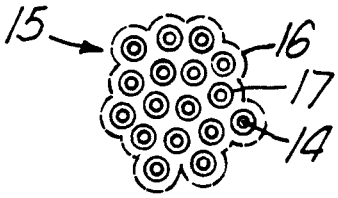
FIGS. 3 and 4 are cross-sectional views through respective treated substrates.

FIG. 3 is a diagrammatic cross-section through a bundle of fine filaments 14 forming a dental floss 15. In dotted lines 16 is indicated the situation as the substrate leaves the bath 4 or 11. However the solids content of the solution is low, usually in the order of 2 to 30 weight % solid content and more preferably in the range of 5 to 15 weight % solid content. This means that there is a very substantial diminution in the volume of what has been picked up as the solvent is evaporated and the charge cures, with the result that at a given cross-section there is little or no permanent bridging of solid charge 17 as between adjacent filamentary elements of the cord or other multi-filament substrate. That is to say this is not a matrix-formation and the flexibility and other characteristics of the cord should not be substantially affected. However the effect of coating onto the elements of the cord an extremely tough and abrasion-resistant coating is substantially to increase the fray or abrasion resistance of the substrate material and also to give it a smoothened and more pleasant "feel" to the user.

This is particularly important when the substrate is straight multi-filamentary material such as dental floss.

Figure 4:
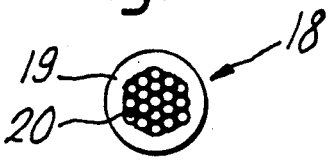

To produce an enrobed cord or thread 18, as diagrammatically shown in FIG. 4, where a cover 19 of polysiloxane is deposited on the outside of the substrate 20 as a whole, a solid content in the higher end of the range is used (and/or the solution is modified by the addition of a thickening agent such as a thixotropic agent, e.g. colloidal silica), no excess pressure is exerted in the bath, and the pressure exerted by any rollers or other feed devices before cure is reduced to the absolute minimum.

There may be no need for any after treatments e.g. the waxing which was conventional in some applications, but for dental floss waxing is considered desirable from the point of view of giving good grip to the user and for holding together the filaments of a floss.

Furthermore for particular envisaged end uses there may be additives incorporated in the prepolymer solution, such as abrasive particles, medicaments e.g. fluoride or chlorhexidine, or microencapsulated ingredients such as flavourings.

What is claimed is:

1. A process for treating a thread-like article comprising at least one filament, said filament or filaments defining an outer envelope of said article, said process comprising the steps of:

(i) applying to the article a dilute solution of a polysiloxane prepolymer, and (ii) curing the prepolymer, such that substantially only said outer envelope of said filament or filaments is enrobed by a protective sheath of cured polysiloxane polymer.

2. A process for treating a thread-like article comprising a plurality of filaments, comprising the steps of:

(i) applying to the article a dilute solution of a polysiloxane prepolymer, and (ii) curing the prepolymer, such that said filaments are substantially only individually encapsulated by a protective sheath of cured polysiloxane polymer.

3. A process according to claim 1 or claim 2, wherein the solution is an acidic solution of a polysiloxane prepolymer having both non-co-reactive side groups and co-reactive side groups, the co-reactive side groups being additional to siloxane linkage-forming alkoxy, hydroxy or carboxy or hydrolysable derivatives thereof, the co-reactive and non-co-reactive groups being linked to respectively different Si atoms, the prepolymer being curable by solvent evaporation to cause the formation of further siloxane linkages and also reaction together of the co-reactive groups to cure and cross-link the polymer.

4. A process according to claim 3 wherein the solution is aqueous throughout the process.

5. A process according to claim 3 wherein the prepolymer is formed in an aqueous solution and thereafter an organic solvent is substituted for the water solvent, whereby said solution is substantially organic.

6. A process according to claim 1 or claim 2, wherein the solution has a solids content which is in the range 2 to 30 weight percent.

7. A process according to claim 1 or claim 2 wherein the solution has a solids content which is in the range 5 to 15 weight percent.

8. A process according to claim 1 or claim 2 wherein the prepolymer solution contains any of the following: thickening agents, abrasive particles, medicaments, flavourings.

9. A process according to claim 1 or claim 2 wherein the article is of a polyamide.

10. A process according to claim 1 or claim 2 wherein the article is any one of the following: dental floss, fishing line, stitching thread.

11. A process according to claim 1 or claim 2 further comprising an additional step of applying wax to the treated article.

12. A thread-like article comprising at least one filament, treated using a process according to claim 1.

13. A thread-like article comprising a plurality of filaments, treated using a process according to claim 2.

* * * * *